US007650895B2

(12) United States Patent
Werner

(10) Patent No.: US 7,650,895 B2
(45) Date of Patent: Jan. 26, 2010

(54) EYE LINER PENCIL

(76) Inventor: Melanie R. Werner, 6 Thorn St., Sewickley, PA (US) 15143

( * ) Notice: Subject to any disclaimer, the term of this patent is extended or adjusted under 35 U.S.C. 154(b) by 839 days.

(21) Appl. No.: 10/922,049

(22) Filed: Aug. 19, 2004

(65) Prior Publication Data

US 2005/0016562 A1 Jan. 27, 2005

Related U.S. Application Data

(63) Continuation-in-part of application No. 10/373,986, filed on Feb. 25, 2003.

(51) Int. Cl.
*A45D 40/24* (2006.01)

(52) U.S. Cl. ..... 132/318

(58) Field of Classification Search ..... 132/320, 132/294, 318, 317, 218; 401/34, 88, 209, 401/216; 206/229, 385, 581, 823
See application file for complete search history.

(56) References Cited

U.S. PATENT DOCUMENTS

| | | | | |
|---|---|---|---|---|
| 2,299,627 | A | 10/1942 | Hunter et al. | |
| 2,442,503 | A | 6/1948 | Melnikoff | |
| 2,901,100 | A * | 8/1959 | Mueller et al. | 401/11 |
| 2,953,142 | A * | 9/1960 | Clementson | 401/96 |
| 3,177,879 | A | 4/1965 | Smith | |
| 3,343,552 | A | 9/1967 | Steffen | |
| 3,352,621 | A | 11/1967 | Fehling et al. | |
| 4,222,677 | A | 9/1980 | Cervantes | |
| 4,428,388 | A | 1/1984 | Cassai et al. | |
| 4,665,912 | A | 5/1987 | Burton | |
| 4,669,492 | A | 6/1987 | von Kleinsorgen | |
| 5,012,663 | A | 5/1991 | Brown | |
| 5,069,232 | A * | 12/1991 | Staar | 132/320 |
| 5,172,994 | A | 12/1992 | Brown | |
| 6,220,254 | B1 | 4/2001 | Gueret | |
| 6,293,720 | B1 | 9/2001 | Zahn | |
| 6,308,371 | B1 | 10/2001 | Forsline | |
| 6,331,085 | B1 * | 12/2001 | Schrepf et al. | 401/128 |
| 6,568,529 | B2 * | 5/2003 | McMurrey | 206/385 |

FOREIGN PATENT DOCUMENTS

| | | |
|---|---|---|
| WO | WO 96/35351 | 11/1996 |

* cited by examiner

*Primary Examiner*—Robyn Doan
(74) *Attorney, Agent, or Firm*—Ansel M. Schwartz

(57) ABSTRACT

An eye liner pencil. The pencil includes an elongate portion which is gripped by the user, the elongate portion having a central axis. The pencil includes a marking portion extending from the elongate portion and in an angular relationship between 5° and 175° with the elongate portion. The marking portion is for marking an eyelid. A lip liner pencil. A method for applying eye liner to an eyelid. A method for applying lip liner to a lip. The pencil can include a plurality of sections.

8 Claims, 2 Drawing Sheets

EYE LINER PENCIL

This application is a continuation-in-part of copending application application Ser. No. 10/373,986 filed on Feb. 25, 2003.

FIELD OF THE INVENTION

The present invention relates to an eye liner pencil. More specifically, the present invention relates to an eye liner pencil having a curved tip, or a straight angled tip that is formed from a plurality of sections.

BACKGROUND OF THE INVENTION

Currently, all eye liners operate in the same manner; that being "color inside wood or plastic wand, straight, pencil-like case. These products are deficient in that they only allow the user to apply the eye liner at an 180° angle. This can be awkward, imprecise and in some cases, unsafe (greater risk of poking eye).

The present invention allows the user to apply the liner at approximately a 90° angle; offering much greater control, precision, improved arm/wrist/hand angle and safety, (less risk of poking eye).

SUMMARY OF THE INVENTION

The present invention pertains to an eye liner pencil. The pencil comprises an elongate portion which is gripped by the user, the elongate portion having a central axis. The pencil comprises a marking portion extending from the elongate portion and in an angular relationship between 5° and 175° with the elongate portion. The marking portion is for marking an eyelid and/or lower lash line.

The present invention pertains to a lip liner pencil having the same features as described for the eye liner pencil.

The present invention pertains to a method for applying eye liner to an eyelid and/or lower lash line. The method comprises the steps of gripping an elongate portion of an eye liner pencil. The elongate portion has a central axis. There is the step of marking the eyelid with a marking portion of the eye liner pencil which is in an angular relationship of between 5° and 175°, and preferably between 30° and 60°, and more preferably about 45°, with the central axis of the elongate portion.

The present invention pertains to a method for applying lip liner to a lip using the same steps as described above for the eyelid, except it is applied to the lip.

The present invention pertains to an eye liner pencil for an eyelid of a user. The pencil comprises a first section and at least a second section. The first section fits on top of the second section. Each section has an elongate portion which is gripped by a user that has a hollow portion and a hole in communication with the hollow portion at a bottom end of the elongate portion and a central axis; and a marking portion extending from the elongate portion at a top end of the elongate portion at a fixed angular relationship between 5° and 175° with the central axis. The marking portion colors the eyelid. The top end of the elongate portion and the marking end of the second section extends from the elongate portion through the hole into the hollow portion of the elongate portion of the first section and the top end of the elongate portion of the second section friction fitting with the hollow portion of the elongate portion of the first section.

The present invention pertains to a method for coloring an eyelid of a user. The method comprises the steps of coloring the eyelid with a tip of a color tube that extends from a top end of an elongate portion at a fixed angular relationship of between 5° and 175° from a central axis of the elongate portion of a first section of an eye liner pencil. There is the step of separating the first section from a second section of the pencil which has a tip of a color tube that extends from a top end of an elongate portion at a fixed angular relationship of between 5° and 175° from a central axis of the elongate portion of the second section that extends through a hole at a bottom end of the first section into the hollow portion of the first section. There is the step of coloring the eyelid with the tip of the second section.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1:
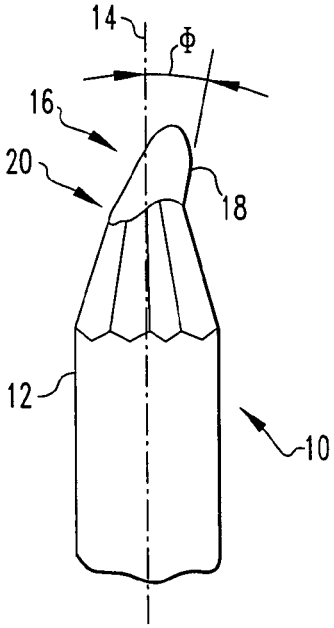
FIG. 1 is a schematic representation of an eye liner pencil with a curved tip.
Figure 2:
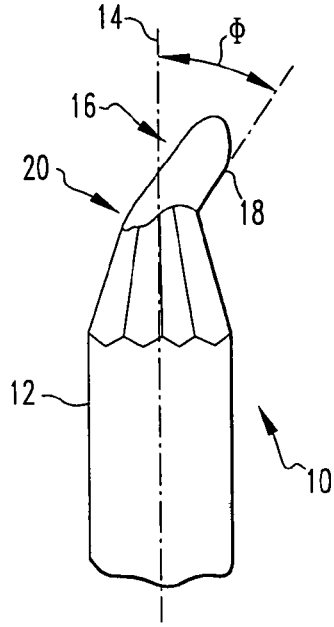
FIG. 2 is a schematic representation of an eye liner pencil with a straight angled tip.

Referring now to the drawings wherein like reference numerals refer to similar or identical parts throughout the several views, and more specifically to FIG. 1 thereof, there is shown an eye liner pencil 10. (Alternatively, it is a lip liner pencil 10.) The pencil 10 comprises an elongate portion 12 having a top end which is gripped by the user, the elongate portion 12 having a central axis 14. The pencil 10 comprises a marking portion 16 extending from the elongate portion 12 and in an angular relationship between 5° and 175°, and preferably between 30° and 60°, and more preferably about 45°, with the central axis 14. The marking portion 16 is for marking an eyelid and/or lower lash line, or lip if it is a lip liner pencil 10 a color. The marking portion 16 is made of the color that is to mark the eyelid. The elongate portion is positioned about the marking portion 16 until a point where the marking portion 16 extends from the elongate portion. Preferably, the marking portion 16 is curved. Alternatively, the marking portion 16 is straight.

The present invention pertains to a method for applying eye liner to an eyelid and/or lower lash line. The method comprises the steps of gripping an elongate portion 12 of an eye liner pencil 10. The elongate portion 12 has a central axis 14. There is the step of marking the eyelid a color with a marking portion 16 of the eye liner pencil 10 that extends from the elongate portion at the top end of the elongate portion at a fixed angular relationship of between 5° and 175°, and preferably about 45°, with the central axis 14 of the elongate portion 12. The marking portion 16 is made of the color that is to mark the eyelid. The elongate portion is positioned about the marking portion 16 until a point where the marking portion 16 extends from the elongate portion. Preferably, the marking portion 16 is curved. Alternatively, the marking portion 16 is straight. The same steps can be used to apply lip liner to a lip, instead of the eye liner to the eyelid.

In the operation of the invention, generally, the eye liner pencil 10 is applied using traditional methods of eye liner application as demonstrated by makeup professionals with one exception; the tip 18 of the eye liner pencil 10 and the hand is positioned at about a 90° angle (versus 180°), allowing greater precision and control of the eye liner pencil 10. This angle also eliminates awkward wrist actions while simultaneously offering greater safety (less risk of poking eye). The same holds true when the eye liner pencil 10 is instead a lip liner pencil 10, and lip liner is applied to the lip.

Most importantly, the angle of the eye liner tip 18 (point) facilitates application of eye liner color, allowing the wearer to place color more smoothly and precisely on the upper lid and the lower lash line; or the lip with the lip liner tip 18.

Description of How to Make the Tip 18:

Fabricate the pencil 10 and insert "color" as usual.

Step 1. Holding the eye liner pencil 10 tip 18 in the DOWNWARD position, pour boiling water to ONE side of the pencil 10 for 15-30 seconds. This process of adding heat gently slowly draws eye liner color out of the tube 20.

The heating process also creates the wooden (pencil-like) case to form the appropriate angle/edge at the point where the color exits the pencil 10.

Step 2: Immediately after applying (liquid) heat, turn the eye liner tip 18 UPWARDS. Using fingers and hand, apply gentle pressure to the OPPOSITE, unheated side of the wand carefully forming and bending tip 18 to desired angle.

Step 3: Allow eye liner pencil 10 to cool at room temperature.

It should be noted that a cap can be used to be placed over the tip, to protect the tip from damage when the pencil is not in use, as is normally done with traditional eye liner pencils. The above description is also applicable to a lip liner pencil 10.

The present invention pertains to an eye liner pencil 10 for an eyelid of a user. The pencil 10 comprises a first section 30*a* and at least a second section 30*b*. The first section 30*a* fits on top of the second section 30*b*. Each section 30 has an elongate portion 12 which is gripped by a user that has a hollow portion 34 and a hole 36 in communication with the hollow portion 34 at a bottom end 38 of the elongate portion 12 and a central axis 14; and a marking portion 16 extending from the elongate portion 12 at a top end 32 of the elongate portion 12 at a fixed angular relationship between 5° and 175° with the central axis 14. The marking portion 16 colors the eyelid. The top end 32 of the elongate portion 12 and the marking end of the second section 30*b* extends from the elongate portion 12 through the hole 36 into the hollow portion 34 of the elongate portion 12 of the first section 30*a* and the top end 32 of the elongate portion 12 of the second section 30*b* friction fitting with the hollow portion 34 of the elongate portion 12 of the first section 30*a*.

Preferably, the marking portion 16 of the first section 30*a* is a different color from the marking portion 16 of the second section 30*b*, although all the marking portions 16 of all the sections 30 can be of the same color. The first section 30*a* is preferably removed from the second section 30*b* when the marking portion 16 of the first section 30*a* is worn down. Preferably, the marking portion 16 includes a color tube 20 extending from the elongate portion 12. The tube 20 has a tip 18 that is at a fixed angular relationship of between 5° and 175° with the central axis 14.

The present invention pertains to a method for coloring an eyelid of a user. The method comprises the steps of coloring the eyelid with a tip 18 of a color tube 20 that extends from a top end 32 of an elongate portion 12 at a fixed angular relationship of between 5° and 175° from a central axis 14 of the elongate portion 12 of a first section 30*a* of an eye liner pencil 10. There is the step of separating the first section 30*a* from a second section 30*b* of the pencil 10 which has a tip 18 of a color tube 20 that extends from a top end 32 of an elongate portion 12 at a fixed angular relationship of between 5° and 175° from a central axis 14 of the elongate portion 12 of the second section 30*b* that extends through a hole 36 at a bottom end 38 of the first section 30*a* into the hollow portion 34 of the first section 30*a*. There is the step of coloring the eyelid with the tip 18 of the second section 30*b*.

Figure 5:
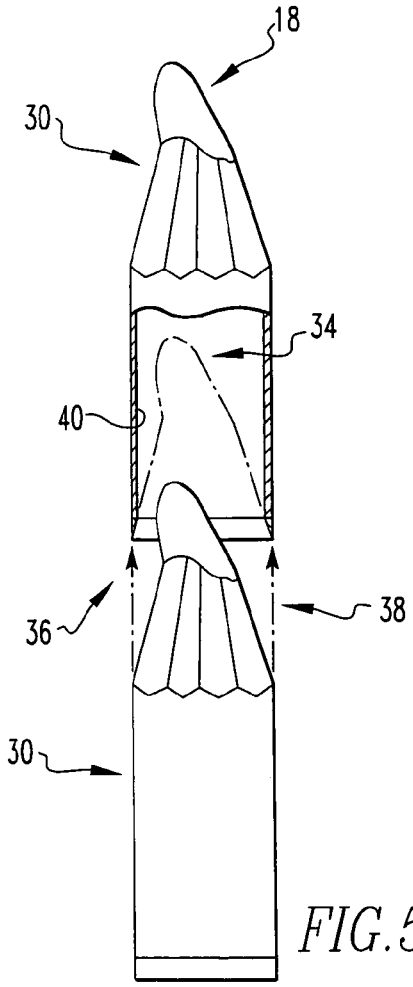
FIG. 5 is a cross-sectional view of a section.
Figure 3:
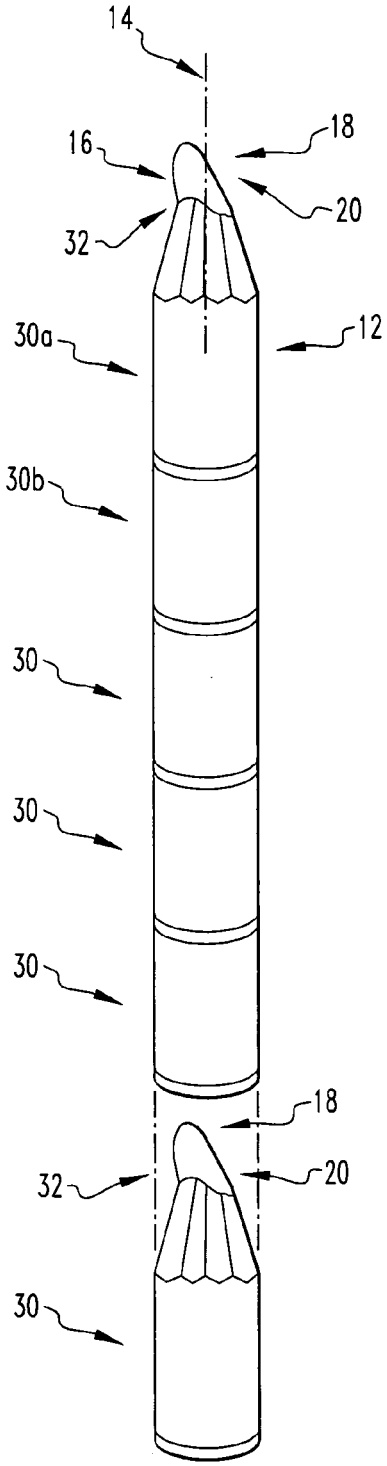
FIG. 3 is a schematic representation of a pencil with a plurality of sections.
Figure 4:
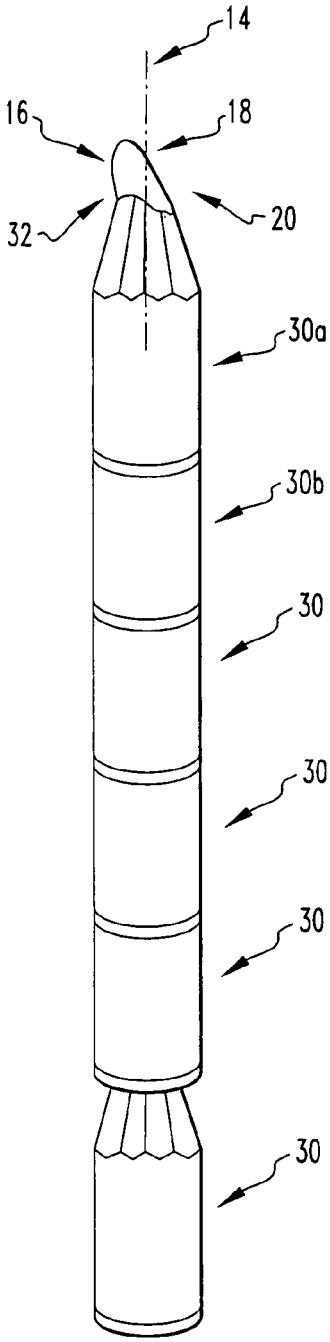
FIG. 4 is a schematic representation of a pencil with a plurality of sections.

In the operation of the alternative embodiment, and as shown in FIGS. 3-5, an eye liner pencil 10 is used to color the eyelid of a user. The eye liner pencil 10 is formed from a plurality of sections 30. There is a first section 30*a* having a tip 18 of a color tube 20 that extends from a top end 32 of an elongate portion 12 at a fixed angular relationship of between 5° and 175° from a central axis 14 of the elongate portion 12, preferably on only one side of the central axis 14. The elongate portion 12 has a hollow portion 34 and a hole 36 in communication with the hollow portion 34 at a bottom end 38 of the elongate portion 12. The user grips the elongate portion 12 to hold the pencil 10 as color is applied to the eyelids of the user. As explained above, because of the angular relationship of the tip 18, it facilitates the application of color to the eyelids.

There is a second section 30*b* of the pencil 10 which has a tip 18 of a color tube 20 that extends from a top end 32 of an elongate portion 12 at a fixed angular relationship of between 5° and 175° from a central axis 14 of the elongate portion 12 of the second section 30*b*. The elongate portion 12 of the second section 30*b* also has a hollow portion 34 and a hole 36 in communication with the hollow portion 34 at a bottom and of the elongate portion 12 of the second section 30*b*. The top end 32 of the elongate portion 12 of the second section 30*b* and the tip 18 of the second section 30*b* extends through the hole 36 of the first section 30*a* into the hollow portion 34 of the elongate portion 12 of the first section 30*a* and the elongate portion 12 of the second section 30*b* friction fits with the inner surface 40 of the hollow portion 34.

When the tip 18 of the first section 30*a* is worn down, or, if the second section 30*b*, or additional sections 30 below the second section 30*b* have a tip 18 of a color that is more desirable than the color of the tip 18 of the first section 30*a*, the first section 30*a* is separated from the second section 30*b*, and the tip 18 of the second section 30*b* is then used to color the eyelid of the user. That is, each section 30 can have a different color tube 20. If it so happens that the tip 18 of a desired color is in a section 30 below the second section 30*b*, then the desired section 30 is separated from the other sections 30, and placed on top of the first section 30*a* through its hollow portion 34, and the section 30 having a tip 18 with the desired color is used to color the eyelid of the user. The tip 18 at the fixed angular relationship of between 5° and 175° from the central axis 14 of the elongate portion 12 is formed as explained above.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An eye liner pencil for an eyelid of a user comprising:

a first section and at least a second section, the first section fits on top of the second section, each section having an elongate portion having a top end, which is gripped by the user, the elongate portion having a central axis; and a marking portion extending from the elongate portion at the top end of the elongate portion at a fixed angular relationship between 5 ° and 175 ° with the central axis, the marking portion for marking an eyelid a color, the marking portion made of the color and a material that is to mark the eyelid, the elongate portion positioned about the marking portion until a point where the marking portion extends from the elongate portion, the marking portion includes a solid color tube, the top end of the elongate portion and the marking end of the second section extending from the elongate portion through the hole into the hollow portion of the elongate portion of the first section and the top end of the elongate portion of the second section friction fitting with the hollow portion of the elongate portion of the first section.

2. A pencil as described in claim 1 wherein the marking portion of the first section is a different color from the marking portion of the second section.

3. A pencil as described in claim 1 wherein the first section is removed from the second section marking portion of the first section is worn down.

4. A method for coloring an eyelid of a user comprising the steps of:

gripping an elongate portion of a first section of an eve liner pencil, the elongate portion having a central axis;

marking the eyelid a color with a marking portion of the eye liner pencil that extends from the elongate portion of the first section at the top end of the elongate portion at a fixed angular relationship of between 5 ° and 175 ° with the central axis of the elongate portion, the marking portion made of the color and a material that is to mark the eyelid, the elongate portion positioned about the marking portion until a point where the marking portion extends from the elongate portion. the marking portion includes a solid color tube that flares to a tip which is at the fixed angular relationship;

separating the first section from a second section of the pencil which has a tip of a color tube that extends from a top end of an elongate portion at a fixed angular relationship of between 5° and 175 ° from a central axis of the elongate portion of the second section that extends through a hole at a bottom end of the first section into the hollow portion of the first section; and coloring the eyelid with the tip of the second section.

5. A method for making an eye liner pencil comprising the steps of:

heating a solid color marking tube extending from an elongate portion; and shaping the heated tube to a fixed angular relationship of between 5 ° and 175° from a central axis of the elongate portion.

6. A method as described in claim 5 wherein the heating step includes the step of passing heated fluid to one side of the elongate portion and color tube.

7. A method as described in claim 6 wherein the heating step includes the step of holding the elongate portion and the tube in a downward position.

8. A method as described in claim 7 wherein the shaping step includes the step of molding the elongate portion and the heated tube in an upright position after the tube has been heated.

* * * * *